US007393156B1

(12) United States Patent
Dunstan

(10) Patent No.: US 7,393,156 B1
(45) Date of Patent: Jul. 1, 2008

(54) CONSTRUCTION APPARATUS FOR PLANTING A SERIES OF VERTICAL POSTS

(75) Inventor: Shane Andrew James Dunstan, Alexandra Hills (AU)

(73) Assignee: Power Curbers, Inc., Salisbury, NC (US)

( * ) Notice: Subject to any disclaimer, the term of this patent is extended or adjusted under 35 U.S.C. 154(b) by 0 days.

(21) Appl. No.: 11/516,853

(22) Filed: Sep. 7, 2006

(51) Int. Cl.
*E01C 19/00* (2006.01)
*E21B 3/00* (2006.01)
*E21B 7/02* (2006.01)

(52) U.S. Cl. ..... 404/83; 404/101; 404/105; 175/170; 175/203; 173/28

(58) Field of Classification Search ..... 404/83, 404/101, 105; 175/170, 203; 173/28
See application file for complete search history.

(56) References Cited

U.S. PATENT DOCUMENTS

| | | | | |
|---|---|---|---|---|
| 2,660,035 | A | 11/1953 | Zeiser | 61/73 |
| 3,252,523 | A | 5/1966 | Kachnik et al. | 172/447 |
| 3,548,604 | A | 12/1970 | Campbell | 61/53.5 |
| 3,696,625 | A | 10/1972 | Alexander | 61/53.5 |
| 3,886,242 | A | 5/1975 | McGregor | 264/31 |
| 4,197,032 | A | 4/1980 | Miller | 404/98 |
| 4,789,266 | A | 12/1988 | Clarke, Jr. et al. | 404/96 |
| 4,808,026 | A | 2/1989 | Clarke, Jr. et al. | 404/90 |
| 4,813,499 | A | 3/1989 | McNulty | 175/122 |
| 5,662,431 | A | 9/1997 | Colvard | 404/105 |
| 6,257,349 | B1 * | 7/2001 | Bardwell | 173/28 |
| 6,293,728 | B1 | 9/2001 | Eggleton et al. | 404/98 |
| 6,675,916 | B1 * | 1/2004 | Mathews | 175/162 |
| 7,004,262 | B1 | 2/2006 | Voichoskie et al. | 173/46 |
| 2005/0103529 | A1 | 5/2005 | Rossi | 175/113 |

FOREIGN PATENT DOCUMENTS

GB 2106953 A * 4/1983

* cited by examiner

*Primary Examiner*—Raymond W Addie
(74) *Attorney, Agent, or Firm*—Kennedy Covington Lobdell & Hickman, LLP

(57) ABSTRACT

A construction apparatus having an arrangement for controlling guidance of a frame thereof along a predetermined path, e.g., a slip-form paving apparatus, has an arrangement for selectively digging vertical bores in the ground surface at spacings along the predetermined path for planting of vertical posts to be secured by the paving material upon setting thereof. In operation, as the construction apparatus is guided over the ground surface along the predetermined path, the bore-digging arrangement is periodically actuated to form vertical bores at spacings along the predetermined path, after which a settable paving material is formed along the predetermined path including filling the vertical bores with the paving material, and posts are placed vertically in the holes for securement therein.

6 Claims, 4 Drawing Sheets

CONSTRUCTION APPARATUS FOR PLANTING A SERIES OF VERTICAL POSTS

BACKGROUND OF THE INVENTION

The present invention relates generally to self-propelled construction equipment including an arrangement for controlled guidance of the propulsion thereof over a ground surface, e.g., a slip-form paving apparatus adapted to continuously slip-form a settable paving material such as concrete into a predetermined cross-sectional shape along the ground or other base surface, and, more particularly, to such an apparatus for planting a series of vertical posts in the ground surface.

Self-propelled concrete paving machines of the general type indicated above are known, representative examples being illustrated and described in U.S. Pat. Nos. 4,789,266; 4,808,026; 5,662,431; and others, which disclose multi-purpose paving machines that can pave roadways, as well as form curbs, gutters, spillways, sidewalks, troughs, barriers, and other continuous concrete extrusions depending upon the configuration of a mold supported by the machine.

In some applications suitable for slip-form paving, such as the formation of highway medians situated between oppositely directed lanes of automotive traffic, it is desirable to provide an elevated barrier above the median, often in the form of bars, cable, wire, rails or the like extending between upright posts or columns spaced periodically along the median. The provision of such barriers in highway medians poses an impediment to the most efficient use of slip-form paving equipment in that the requisite support posts cannot be planted in the ground along the path of the intended median in advance of the slip-forming of the median. Thus it is conventionally necessary to install the posts after formation of the median, which requires that bores must be formed in the paving material in order to accommodate the securement of the posts.

SUMMARY OF THE INVENTION

It is accordingly an object of the present invention to provide a novel construction apparatus for coordinating the planting of series of vertical posts in conjunction with the formation of a surrounding structure such as a slip-formed median or other barrier. It is a further object of the present invention to provide such an apparatus which will significantly lessen the time required for, and commensurately improve the efficiency of, the formation of post-implanted barriers. A still further object of the invention is to provide the applicable construction apparatus with an arrangement for selectively digging a series of vertical bores in a ground surface.

Briefly summarized, the present invention is essentially adaptable to essentially any self-propelled construction apparatus of the type adapted for controlled guidance along a predetermined path, e.g., via a stringline responsive guidance system, a GPS (global positioning system) based guidance system, or any other suitable automated guidance system, such as are known generally in slip-form paving apparatus adapted for continuously slip-forming concrete or other settable paving material into a predetermined cross-sectional shape along the ground or other surface. Such construction apparatus basically comprises a frame, a suitable arrangement for propulsion of the frame over the ground surface, and an appropriate guidance system such as described above. In accordance with the present invention, the construction apparatus is provided with an arrangement for selectively digging vertical bores in the ground surface along the predetermined guided path of the apparatus.

In a preferred embodiment of the invention, the construction apparatus is a slip-form paving apparatus for continuously slip-forming a settable paving material into a predetermined cross-sectional shape along a ground surface, including an arrangement for depositing the paving material onto the ground surface during propulsion of the frame thereover and a mold configured for slip-forming the deposited paving material in the predetermined cross-sectional shape. The apparatus may comprise an arrangement for driving the bore digging arrangement, such as a power take-off associated with the motive propulsion arrangement of the apparatus.

According to another aspect of the present invention, the construction apparatus is utilized in operation for planting a series of vertical posts in a ground surface, basically by the steps of periodically actuating the bore-digging arrangement to form vertical bores at spacings along the predetermined path, forming a settable paving material along the predetermined path, including filling the vertical bores with the paving material, and placing posts vertically in the holes for securement therein.

Preferably, the slip-forming of the paving material comprises depositing the paving material onto the ground surface in and about the series of bores during guiding of the construction apparatus over the ground surface and molding the paving material into a predetermined cross-sectional shape.

DESCRIPTION OF THE PREFERRED EMBODIMENT

Figure 1:
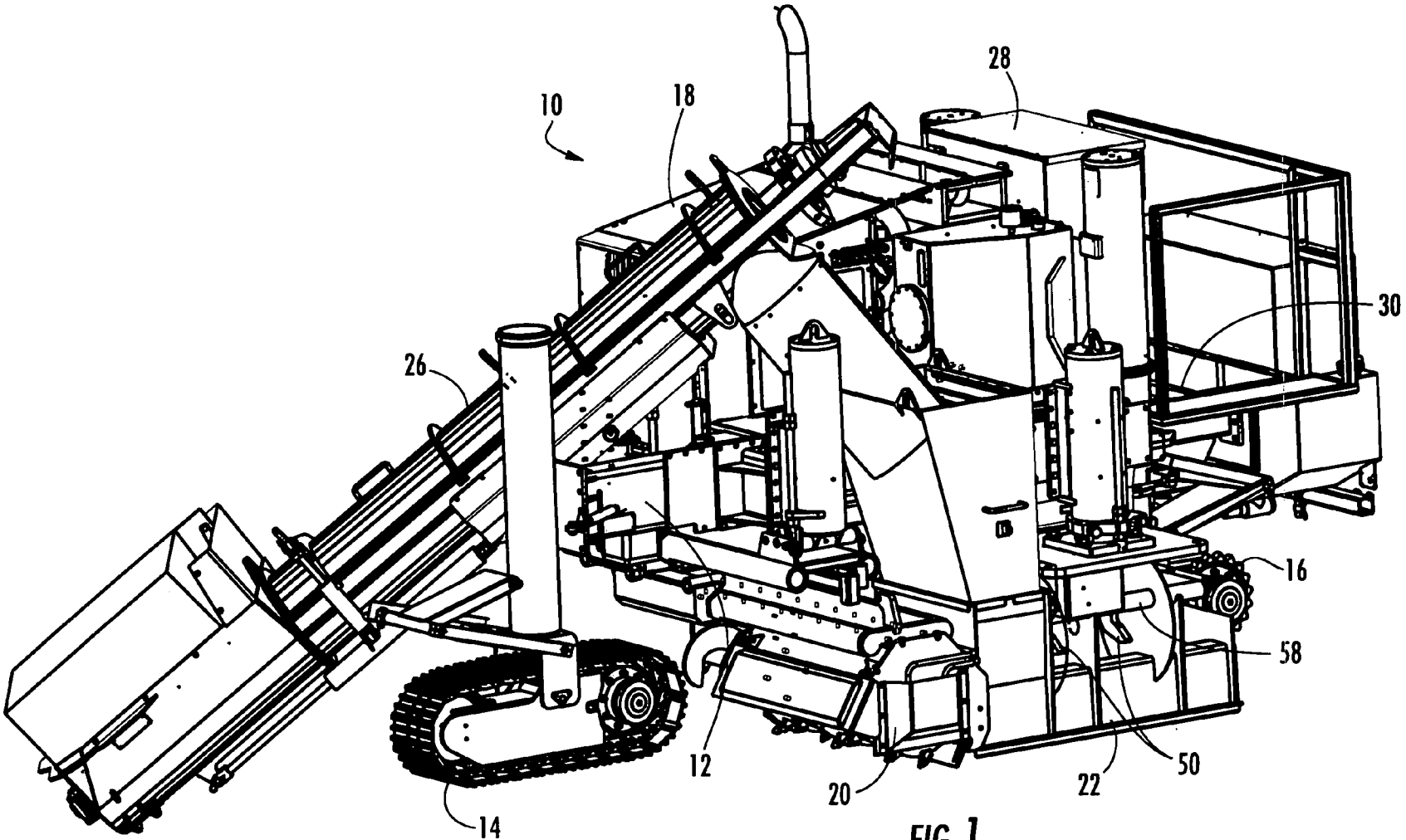
FIG. 1 is a front perspective view of a slip-form paving apparatus outfitted in known manner for slip-form paving operation, and for which a bore digging device has been adapted in accordance with the preferred embodiment of the present invention.
Figure 2:
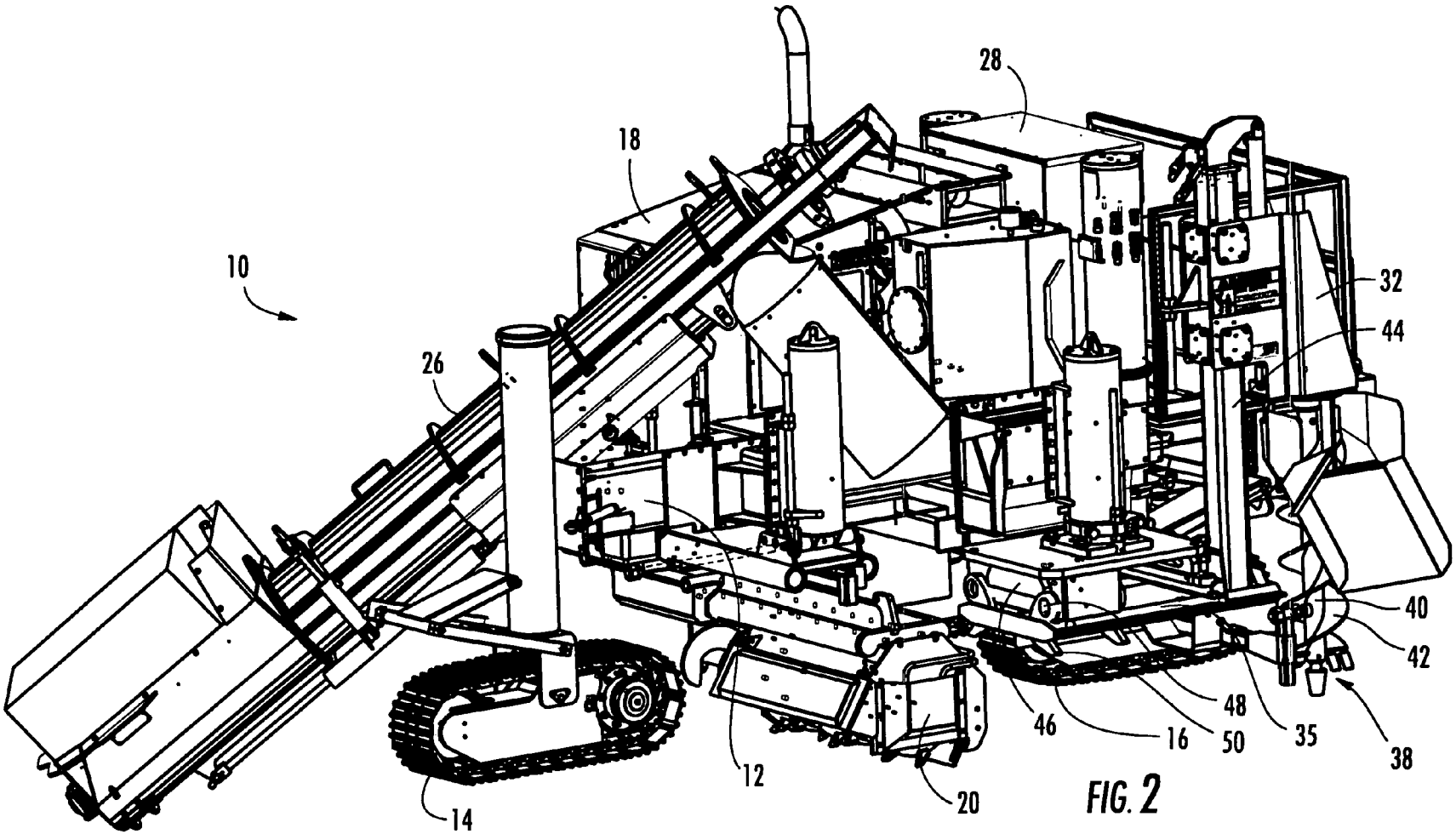
FIG. 2 is a similar front perspective view of the slip-form paving apparatus of FIG. 1, equipped with a bore digging device in accordance with the preferred embodiment of the present invention.

Referring now to the accompanying drawings and initially to FIGS. 1 and 2, the present invention is depicted as embodied in a self-propelled slip-form paving apparatus, indicated in its totality at 10. However, while such an apparatus comprises one of the presently preferred potential embodiments of the invention, it is contemplated and is to be understood that the invention is applicable to a much broader scope of applications, as those persons skilled in the art will appreciate, and in particular, the invention may be embodied in substantially any construction apparatus which is adapted to be self-propelled and guided automatically along a predetermined path of operative travel, e.g., via stringline guidance arrangement, as in many slip-form paving machines, or via a GPS guidance system, or any other such guidance systems, whether presently known or newly developed in the future. Hence, the present invention is not to be construed as limited to embodiment in a slip-form paving apparatus.

For sake of illustrating and describing the present invention, the paving apparatus 10 may be of essentially of the same basic construction and operation as that of U.S. Pat. No. 5,662,431, commonly owned with the present invention. The paving apparatus 10 basically comprises a structural framework 12 supported substantially horizontally on front and rear drive assemblies 14,16, preferably in the form of so-called crawler assemblies of the endless track type. Preferably, a single front drive assembly 14 and a pair of rear drive assemblies 16 (only one of which is shown in FIG. 1) are mounted to the frame 12 in triangular relation to one another to provide stable suspension of the frame 12. An internal combustion engine 18 or other suitable self-contained power generator, preferably in conjunction with a hydraulic pump (not indicated) or other suitable power take-off arrangement, is mounted to the machine frame 12 to provide drive power to the crawler assemblies 14, 16, preferably through individual hydraulic motors on each respective crawler assembly, and to otherwise supply operational power to the various systems of the paving apparatus.

The embodiment of the paving apparatus 10 depicted in the accompanying drawings is particularly adapted for the continuous slip-forming of a concrete median or barrier such as typically formed along a roadway during road construction. However, as those persons skilled in the art will understand, the essential features and inventive concepts forming the present invention are equally well-adapted to substantially any other form of self-propelled paving apparatus of the slip-form type wherein concrete or another flowable, settable paving material is continuously deposited in a molded form according to a predetermined cross-sectional shape defined by a mold structure transported by the apparatus. Hence, is it is to be understood that the present invention is not limited to barrier-paving machines but is equally susceptible to application in machines for slip-forming of roadways, gutters, spillways, sidewalks, troughs, barriers, and any other form of continuous concrete extrusion.

As will be understood, the ground surface on which the curb or other pavement is to be laid in molded form will be prepared in advance by suitable construction grading equipment. In order to provide a suitable grade of the ground surface immediately in advance of the paving operation, the apparatus 10 is preferably equipped with a trimmer structure 20 at the forward end of the frame 12. Basically, the trimmer structure 20 includes a rotatably driven roller having digging teeth projecting from its outer periphery for the purpose of partially digging into the ground surface to loosen and uniformly distribute the soil on which the pavement is to be formed. Additionally, the trimmer structure 20 may includes a scraper blade extending transversely across the rearward side of the digging roller to level the loosened soil. Such trimmer structures are known, e.g., as described and illustrated in Clarke, Jr. et al U.S. Pat. No. 4,808,026 and Miller U.S. Pat. No. 4,197,032, and therefore are not believed to need further description herein.

As shown in FIG. 1, a suitable mold 22 may be supported from the frame 12 immediately rearwardly of the trimmer structure. As previously indicated, the mold 22 is of a particular interiorly profiled configuration in the desired form of a roadway median barrier for purposes of representative illustration and description of an exemplary embodiment of the present invention. To best facilitate a median laying operation, the mold 22, along with the trimmer structure 20, is mountable at one side of the frame 12, although it will be understood that other molds may be centrally located in applications of the invention in other slip-form paving machines.

The mold 22 is mounted to and demounted from the paving apparatus 10 by a pivoting latch mechanism 46 by which the mold 22 may be selectively mounted to and demounted from the frame 12. The latching mechanism 46 provides a pair of spaced parallel actuating shafts 48 hydraulically rotatable selectively to control inward and outward pivoting of a pair of hook-shaped latching levers 50 fixed to the opposite ends of each shaft 48 to selectively engage or release a pair of fixed parallel bars 58 along the opposite sides of the mold 22. Thus, by pivoting the latching levers 50 inwardly toward one another, the parallel bars 58 of the mold 22 can freely pass upwardly and downwardly relative to the latching mechanism 46 without engagement by the levers 50 for positioning of the mold 22 correctly relative to the latching mechanism 46, whereupon pivoting of the levers 50 outwardly causes the hooked ends of the levers 50 to engage the bars 58 to securely couple the mold 22 to the latching mechanism 46. Such positioning of the mold 22 and the latching mechanism 46 to accomplish such mounting operation may be easily performed with the mold 22 resting on the ground surface. Of course, as will be appreciated by those persons skilled in the art, other means than the specific latching mechanism 46 may be employed for facilitating mounting and demounting of the mold 22 to the paving apparatus 10.

An upright concrete hopper 24 is affixed to the forward end of the mold 22 in upstanding disposition to extend upwardly from the mold 22 to provide a continuous supply of concrete or other suitable flowable, settable paving material into the mold interior. A concrete conveyor 26 extends angularly at an upward incline from the opposite side of the machine frame 12, terminating into the upward end of the hopper 24. In this manner, the hopper 24 can be continuously stocked with a suitable supply of concrete, e.g., from a concrete mixing truck (not shown) positioned to progressively feed concrete into the conveyor 26.

An operator control console 28 with an operator support platform 30 is mounted widthwise across the rearward end of the frame 12 in an elevated position from which an operator can view and control the various operating systems of the paving apparatus 10. As will be understood, once a supply of concrete is established into the hopper 24, the basic operation of the paving apparatus progresses by driving the crawler assemblies 14, 16 to propel the apparatus 10 in a predetermined guided path of travel, e.g., via a stringline guide prepositioned along the desired path, whereby concrete from the hopper 24 is progressively delivered into the mold 22 and, in turn, extruded from the rear of the mold 22 in the cross-sectional configuration of its internal profile.

To the extent thus far described, the structure and operation of the paving apparatus 10 is essentially conventional and is in accordance with the apparatus described and illustrated in commonly-owned U.S. Pat. No. 5,662,431. As already indicated, the present invention provides a novel means by which vertical bores may be dug into the ground surface underlying the paving apparatus 10 when necessary or desirable as part of an overall paving operation, such as, by way of example only, to facilitate the planting of a series of barrier posts or columns to upstand from the intended median barrier for carrying barrier wires, cables, rails or the like between the posts, as will be described more fully herein.

More specifically, in accordance with a preferred embodiment of the present invention, the paving apparatus 10 is equipped with a post hole digging device, generally indicated in its totality at 32 in FIG. 2, mountable to the frame 12 of the apparatus 10 at a rearward corner thereof immediately rearwardly of the normal operating location of the mold 22. In the presently preferred embodiment, the post hole digging apparatus 32 is configured for mounting support from the frame 12 via the same latching mechanism 46 as the mold 22. Thus, when operation of the post hole digging device 32 is desired, the mold 22 is demounted from the latching mechanism 46 and the post hole digging device 32 is mounted in its place to the latching mechanism 46. When slip-form paving operation of the apparatus 10 is desired, the post hole digging device 32 is demounted from the latching mechanism 46 and the mold 22 is mounted in its place to the latching mechanism 46. For this purpose, the post hole digging device 32 has a subframe comprised of a pair of mounting bars 35 cantilevered forwardly in spaced parallel relation for engagement with the levers 50 of the latching mechanism 46, in comparable manner as described above for mounting of the mold 22, thereby to mount the post hole digging device 32 from the frame 12. However, as will be readily recognized, it is also contemplated as an alternative that the post hole digging device 32 may be mounted to the apparatus 10 separately from the mold latching mechanism 46, whereby the mold 22 and post hole digging device 32 need not necessarily be interchanged, but could both be mounted to the frame 12 simultaneously.

The post hole digging device 32 further comprises an hydraulic drive motor (not shown) from which an auger 38 extends vertically downwardly. The auger 38 has a central shaft 40 affixed to the hydraulic motor 36 for driven rotation thereby and a helical blade 42 for digging penetration of the underlying ground surface. The hydraulic drive motor 36 is supported on a guide rail 44 upstanding from the frame 12 to be movable vertically therealong relative to the frame 12 via the hydraulic motor 36 into and out of ground boring engagement between an elevated position wherein the auger 38 is withdrawn upwardly at a spacing above the underlying ground surface and a downwardly extended position wherein the auger 38 penetrates the ground surface.

Figure 3:
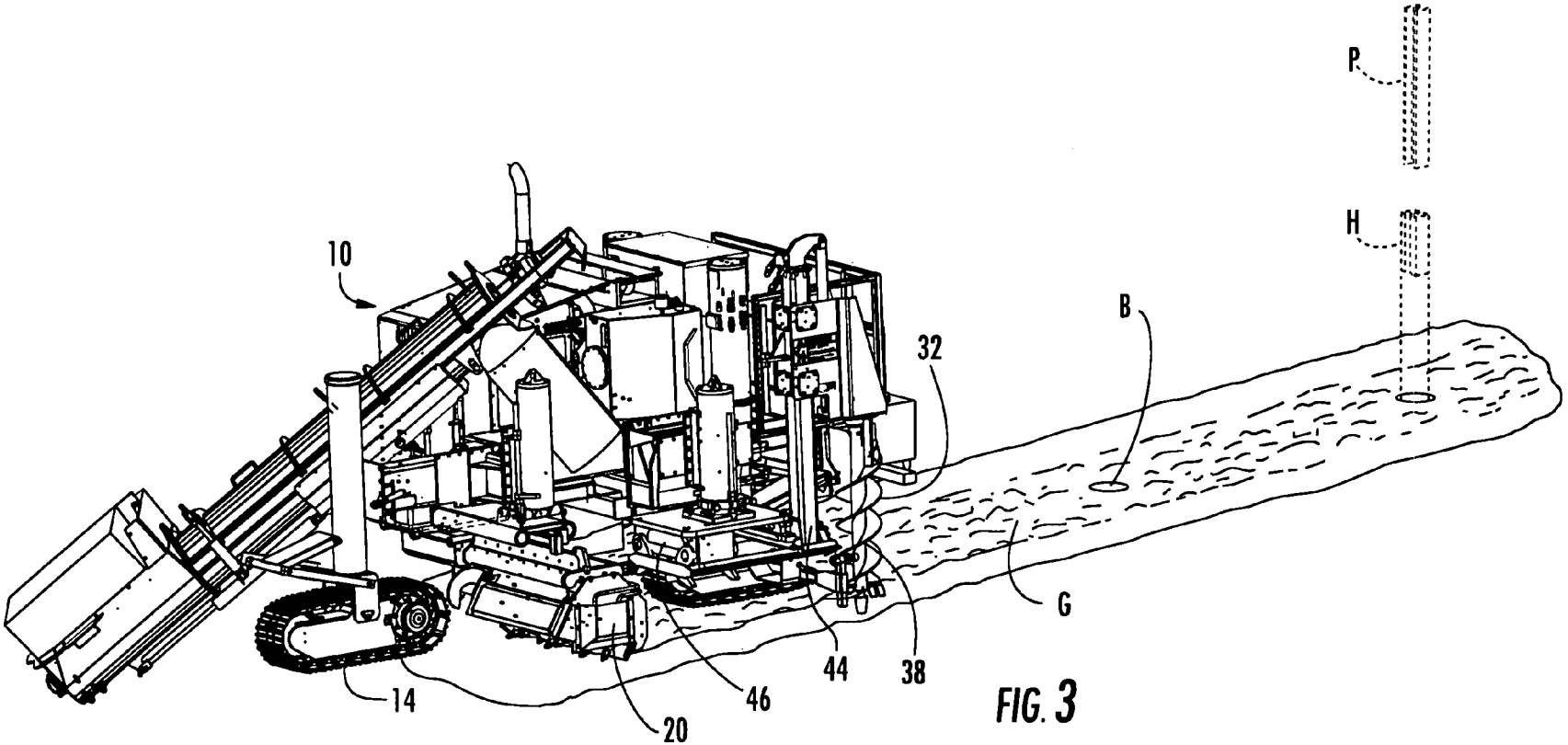
FIG. 3 and FIG. 4 are similar perspective views of the paving apparatus equipped as in FIG. 2, depicting the apparatus at successive stages in the methodology of using the apparatus for planting a series of posts.
Figure 4:
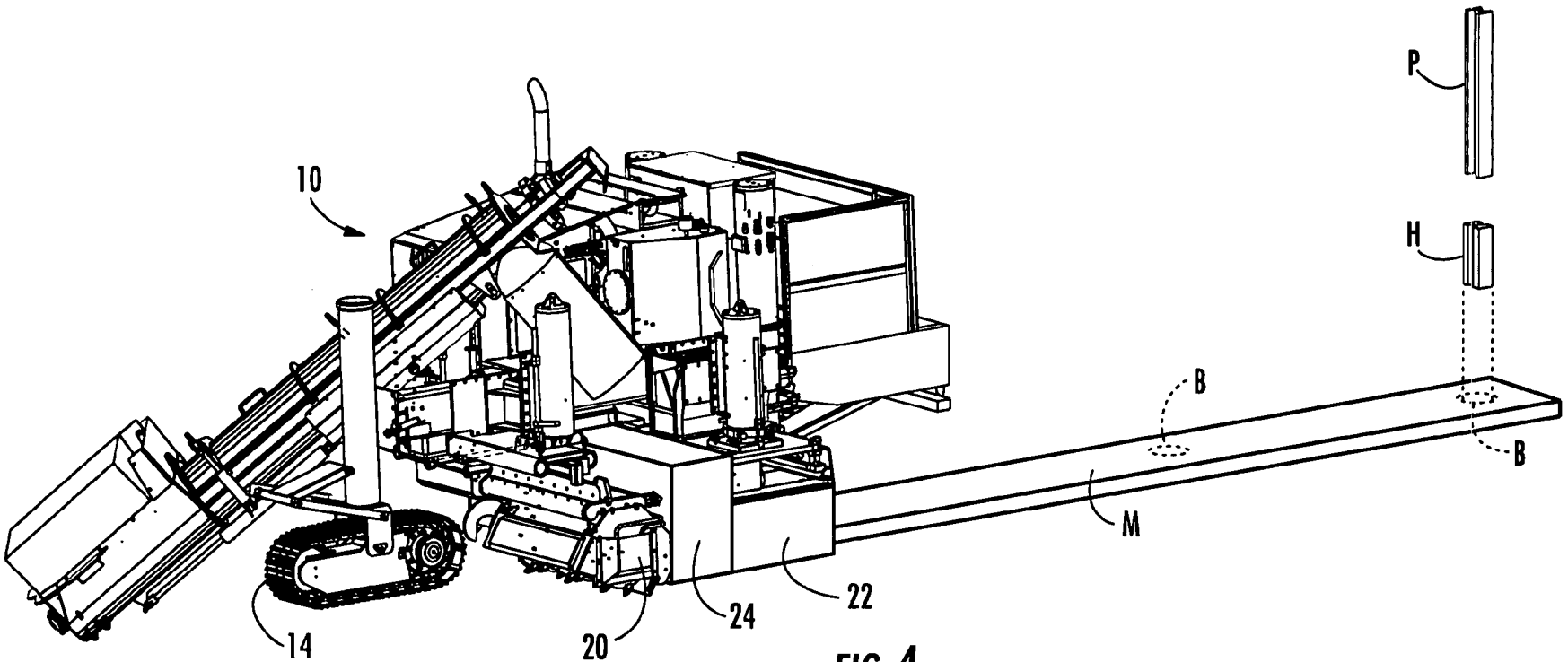

The operation of the construction apparatus 10 may thus be understood with reference to FIGS. 3 and 4. Initially, as depicted in FIG. 3, the apparatus 10 is outfitted with the mold 22 removed and with the post hole digging device 32 installed via the latching mechanism 46. The apparatus 10 is guided, e.g., via a stringline guide, in a previously determined path of travel along the desired location for a highway median barrier, while the trimmer structure 20 is operated to prepare the ground surface G underlying the intended median barrier. As the apparatus 10 progresses along such path, the operator intermittently stops the forward progress of the apparatus 10 at spaced intervals corresponding to the desired spacing of barrier posts along the median, during which temporary stoppages the post hole digging device 32 is actuated to drivenly rotate and extend the auger 38 into the prepared ground surface G to bore post holes B at spacings therealong.

After post holes B have been bored along a desired stretch of the ground surface G, the apparatus 10 is re-outfitted for paving operation by demounting the post hole digging device 32 and mounting the mold 22 in its place to the latching mechanism 46. The apparatus 10 is then driven in a second pass along the identical guided path of travel while a supply of concrete is delivered via the conveyor 26 into the hopper 24 and therefrom to the mold 22 to slip-form a continuous strip of concrete into the desired form for the median M, all as depicted in FIG. 4. As the apparatus 10 passes over each post hole B previously bored in the first pass of the apparatus 10, the concrete fills each hole. While the formed concrete remains wet before becoming set, i.e., solidifying, a worker or work crew closely following the apparatus 10 inserts a post P or a post holder H downwardly through the wet concrete and into each post hole B therebelow. It is known in some barrier wire support post assemblies to install into the ground or into the concrete of the median a sleeve-like post holder H of a matching cross-sectional shape to that of the intended posts, whereby the post holder sleeves H can be set into the wet unset concrete and the posts P can be later inserted into the holder sleeves H after the concrete has become set. Of course, the use or non-use of such post holders H forms no part of the present invention and, if desired, the present invention equally contemplates the possibility that posts P can be inserted upright directly into the wet concrete and downwardly into the pre-formed holes B without the use of sleeve-like or other post holders H. Alternatively, if post holders H are to be used, the holders H could be installed directly into the post holes B and back filled with concrete immediately after the ground preparation and hole formation during the first pass of the apparatus 10 and before the second pass slip-forming the median strip, as depicted in phantom lines in FIG. 3, so long as the holders H are secured within each hole B at a level below the elevation of the mold during the subsequent slip-forming pass of the apparatus.

While the invention has been described as utilizing a worker or work crew following the apparatus 10 to manually insert posts P or post holders H through the wet concrete and into each post hole B therebelow, it is contemplated that the construction apparatus 10 may also be provided with a mechanical, hydraulic or other automated device or arrangement to store and feed a supply of posts P and/or holders H, e.g., from a delivery magazine, and to automatically insert such holders H and/or posts P downwardly into the bored holes B. For example, such an automated arrangement may include a pusher mechanism for driving the holders H and/or posts P through the wet concrete. In order to avoid the necessity of momentarily stopping the advancing motion of the paving operation of the apparatus at the intervals of the previously formed holes B, the automated arrangement could be mounted via an extendable or swingable form of support following the post hole digging device 32 to allow the post or holder planting operation to be carried out without interruption of the traveling motion of the apparatus.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A construction apparatus having a frame, a motive arrangement for propulsion of the frame over a ground surface, an arrangement for controlling guidance of the frame along a predetermined path, and an arrangement for selectively digging vertical bores in the ground surface at spacings along the predetermined path, and an arrangement for slip-forming a settable paving material into a predetermined cross-sectional shape along the predetermined path.

2. A construction apparatus according to claim 1, further comprising an arrangement for driving the bore digging arrangement.

3. A construction apparatus according to claim 2, wherein the arrangement for driving the bore digging arrangement comprises a power take-off associated with the motive arrangement.

4. A construction apparatus for continuously slip-forming a settable paving material into a predetermined cross-sectional shape along a ground surface, the apparatus comprising a frame, a motive arrangement for propulsion of the frame over the ground surface, an arrangement for controlling guidance of the frame along a predetermined path, an arrangement for depositing the paving material onto the ground surface during propulsion of the frame thereover, a mold configured for slip-forming the deposited paving material in the predetermined cross-sectional shape, and an arrangement for selectively digging vertical bores in the ground surface at spacings along the predetermined path for planting of vertical posts to be secured by the paving material upon setting thereof.

5. A construction apparatus accordingly for claim 4, further comprising an arrangement for driving the bore digging arrangement.

6. A construction apparatus according to claim 5, wherein the arrangement for driving the bore digging arrangement comprises a power take-off associated with the motive arrangement.

* * * * *